US011141980B2

(12) United States Patent
Hayasaka

(10) Patent No.: US 11,141,980 B2
(45) Date of Patent: Oct. 12, 2021

(54) PRINTING APPARATUS

(71) Applicant: SEIKO EPSON CORPORATION, Tokyo (JP)

(72) Inventor: Nobuyuki Hayasaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/872,625

(22) Filed: May 12, 2020

(65) Prior Publication Data

US 2020/0361209 A1 Nov. 19, 2020

(30) Foreign Application Priority Data

May 13, 2019 (JP) ..... JP2019-090459

(51) Int. Cl.

| | |
|---|---|
| ***B41J 2/17*** | (2006.01) |
| ***B41J 11/00*** | (2006.01) |
| ***B41M 7/00*** | (2006.01) |
| *B41J 2/165* | (2006.01) |

(52) U.S. Cl.

CPC ..... *B41J 2/1714* (2013.01); *B41J 11/002* (2013.01); *B41M 7/0045* (2013.01); *B41J 2/16511* (2013.01); *B41J 2002/16514* (2013.01)

(58) Field of Classification Search

CPC ..... B41J 2/1714

See application file for complete search history.

(56) References Cited

U.S. PATENT DOCUMENTS

2013/0229458 A1* 9/2013 Masuda ..... B41J 2/1652 347/30
2014/0240418 A1 8/2014 Masuda
2020/0307221 A1* 10/2020 Masuda ..... B41J 11/002

FOREIGN PATENT DOCUMENTS

JP 2014-162121 9/2014

* cited by examiner

*Primary Examiner* — Justin Seo
(74) *Attorney, Agent, or Firm* — Workman Nydegger

(57) ABSTRACT

A printing apparatus includes a transport unit for a printing medium, a head configured to discharge ultraviolet-curable ink, an ultraviolet light irradiation unit disposed downstream of the head, a suction unit provided between the head and the ultraviolet light irradiation unit, and a gap reducing portion disposed in a gap between the head and the suction unit and configured to at least partially close the gap by a first region being in contact with the suction unit and a second region, located upstream of the first region, being in contact with the head. In response to the suction unit suctioning mist while the head discharges ink onto the printing medium to be transported, air flow traveling in a direction opposite to the transport direction is generated in a region where the ultraviolet light irradiation unit and the printing medium oppose each other.

11 Claims, 6 Drawing Sheets

PRINTING APPARATUS

The present application is based on, and claims priority from JP Application Serial Number 2019-090459, filed May 13, 2019, the disclosure of which is hereby incorporated by reference herein in its entirety.

BACKGROUND

1. Technical Field

The disclosure relates to a printing apparatus.

2. Related Art

In the related art, there is known a printing apparatus in which a head discharges ultraviolet curable ink and an ultraviolet light irradiation unit irradiates ultraviolet light to cure the ink and form an image on a printing medium to be transported. One example of such a printing apparatus includes a suction unit for suctioning mist to prevent ink mist from adhering to the UV irradiation unit. For example, JP-A-2014-162121 discloses a liquid discharge device including first and second heads configured to discharge droplets of a photocurable liquid, first and second irradiation units configured to irradiate the photocurable liquid with light, and first and second mist collectors configured to collect mist.

As in the liquid discharge device disclosed in JP-A-2014-162121, a suction unit is often formed downstream of the head and upstream of the ultraviolet light irradiation unit in the transport direction of the printing medium. However, air flow that travels along the transport direction of the printing medium may be generated when the printing medium is transported. When such air flow is generated, mist that is generated at the head and not completely suctioned by the suction unit may reach the ultraviolet light irradiation unit and adhere to the ultraviolet light irradiation unit. Mist that has adhered to the ultraviolet light irradiation unit may cure and cause problems when the ultraviolet light is irradiated.

SUMMARY

A printing apparatus according to the present invention for solving the above-described problems includes a transport unit for a printing medium, a head configured to discharge ultraviolet-curable ink onto the printing medium, an ultraviolet light irradiation unit disposed downstream of the head in a transport direction of the printing medium, a suction unit with a suction port configured to suction mist of the ink and provided between the head and the ultraviolet light irradiation unit in the transport direction, and a gap reducing portion disposed in a gap between the head and the suction unit in the transport direction and configured to at least partially close the gap by a first region being in contact with the suction unit and a second region located upstream of the first region in the transport direction being in contact with the head, in which, in response to the suction unit suctioning the mist while the head discharges the ink onto the printing medium to be transported, air flow traveling in a direction opposite to the transport direction is generated in an opposing region where the ultraviolet light irradiation unit and the printing medium oppose each other.

DESCRIPTION OF EXEMPLARY EMBODIMENTS

Figure 1:
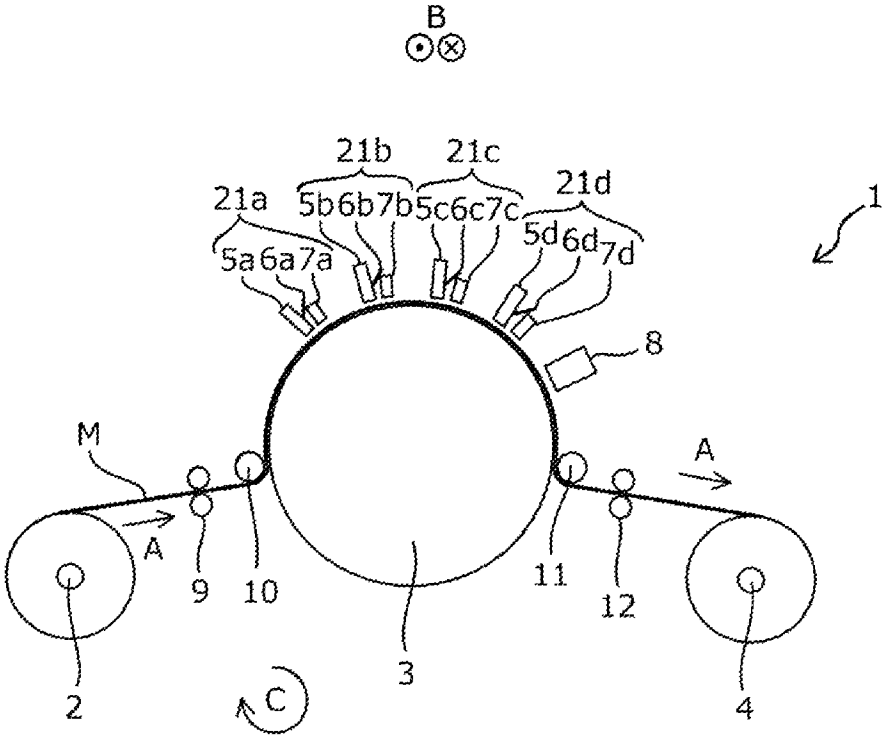
FIG. 1 is a schematic side view of a printing apparatus according to an embodiment of the present disclosure.

First, the present disclosure will be schematically described.

A printing apparatus according to a first aspect of the present disclosure for solving the above-described problem includes a transport unit for a printing medium, a head configured to discharge ultraviolet-curable ink onto the printing medium, an ultraviolet light irradiation unit disposed downstream of the head in a transport direction of the printing medium, a suction unit with a suction port configured to suction mist of the ink and provided between the head and the ultraviolet light irradiation unit in the transport direction, and a gap reducing portion disposed in a gap between the head and the suction unit in the transport direction and configured to at least partially close the gap by a first region being in contact with the suction unit and a second region located upstream of the first region in the transport direction being in contact with the head, in which, in response to the suction unit suctioning the mist while the head discharges the ink onto the printing medium to be transported, air flow traveling in a direction opposite to the transport direction is generated in an opposing region where the ultraviolet light irradiation unit and the printing medium oppose each other.

According to the present aspect, the gap reducing portion is formed between the head and the ultraviolet light irradiation unit. By forming the gap reducing portion, air flow in the gap weakens and air flow toward the suction unit in the opposing region is generated more easily. Further, it is possible to suppress the generation of air flow in the transport direction within the opposing region in response to transport of the printing medium. Furthermore, the formed gap reducing portion is configured to generate air flow in a direction opposite to the transport direction in the opposing region when mist is suctioned while printing is performed. As a result, mist generated in the head can be suppressed from traveling toward the ultraviolet light irradiation unit. Therefore, it is possible to suppress mist adhering to the ultraviolet light irradiation unit.

A printing apparatus according to a second aspect of the present disclosure is the printing apparatus according to the first aspect, in which the second region of the gap reducing portion makes contact with the head without being fixed to the head, and the head is movable in directions approaching and separating from the printing medium while the second region is in contact with the head.

According to the present aspect, because the head is movable in directions approaching and separating from the printing medium while the gap reducing section is in contact with the head, the gap between the head and the printing medium can be adjusted while maintaining a state where mist is suppressed from adhering to the ultraviolet light irradiation unit.

A printing apparatus according to a third aspect of the present disclosure is the printing apparatus according to the first or second aspect, in which the transport unit is configured to transport the printing medium in a plurality of transport modes of different transport speeds, and air flow traveling in the direction opposite to the transport direction is generated in the opposing region in any of the transport modes.

According to the present aspect, because the printing apparatus can transport the printing medium in a plurality of transport modes with different transport speeds, printing can be performed based on a transport mode for printing while giving priority to printing speed and a transport mode for printing while giving priority to printing accuracy. Furthermore, regardless of the selected transport mode, it is possible to suppress mist from adhering to the ultraviolet light irradiation unit.

A printing apparatus according to a fourth aspect of the present disclosure is the printing apparatus according to the third aspect, in which the suction unit is configured to suction in a plurality of suction modes of different suction strengths, and the suction mode is configurable according to the transport mode.

According to the present aspect, because the printing apparatus has a plurality of suction modes with different suction strengths, selecting the suction mode according to the selected transport mode makes it possible to effectively suppress mist from adhering to the ultraviolet light irradiation unit.

A printing apparatus according to a fifth aspect of the present disclosure is the printing apparatus according to the third or fourth aspect, in which, even in a maximum transport speed mode among the transport modes, the gap reducing portion at least partly closes the gap such that air flow traveling in the direction opposite to the transport direction is generated in the opposing region.

According to the present aspect, even in the maximum transport speed mode, the gap reducing portion at least partly closes the gap such that air flow traveling in the direction opposite to the transport direction is generated in the opposing region. Thus, it is possible to suppress mist from adhering to the ultraviolet light irradiation unit even when a maximum transport speed mode is selected.

A printing apparatus according to a sixth aspect of the present disclosure is the printing apparatus according to any one of the first to fifth aspects, in which the gap reducing portion is formed of a flexible resin.

According to the present aspect, because the gap reducing portion is formed of a flexible resin, the gap can be closed using a simple configuration.

A printing apparatus according to a seventh aspect of the present disclosure is the printing apparatus according to any one of the first to sixth aspects, in which the gap reducing portion has a length in an intersecting direction that intersects with the transport direction greater than or equal to a length of the head in the intersecting direction.

According to the present aspect, because the length of the gap reducing portion in the intersecting direction is greater than or equal to the length of the head in the intersecting direction, air flow toward the suction unit can be effectively generated in the opposing region and mist can be effectively suppressed from adhering to the ultraviolet light irradiation unit.

Embodiments of the present disclosure will be described below with reference to the accompanying drawings.

First, an overview of a printing apparatus 1 according to an embodiment of the present disclosure will be described with reference to FIG. 1.

The printing apparatus 1 according to the present embodiment is a printing apparatus configured to print an image on a printing medium M such as paper, cloth or film. The printing apparatus 1 is communicably connected to a computer (not shown), which is an external device. Note that, as illustrated in FIG. 1, the printing apparatus 1 according to the present embodiment is able to print onto a printing medium M that has been rolled into a roll, but may be configured to print onto a cut printing medium M such as cut paper.

As illustrated in FIG. 1, the printing apparatus 1 according to the present embodiment includes a dispenser part 2 configured to dispense the printing medium M by setting the roll-shaped printing medium M and rotating the printing medium M in a rotation direction C. The dispenser part 2 feeds the printing medium M to a first transport roller pair 9. Then, the first transport roller pair 9 transports the printing medium M in a transport direction A.

Figure 2:
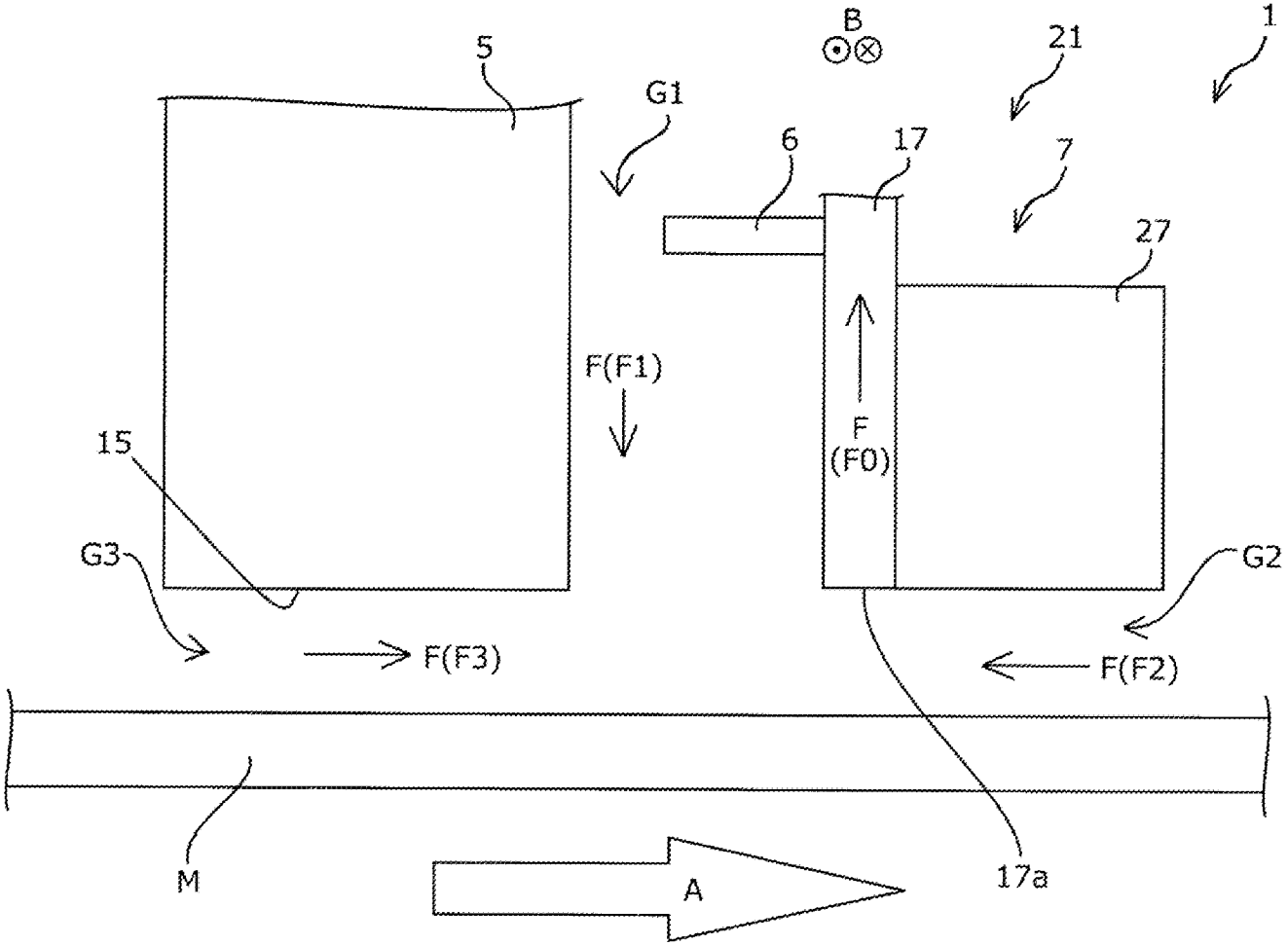
FIG. 2 is a conceptual diagram of a printing apparatus according to an embodiment of the present disclosure, and illustrates the direction of air flow when transport speed is fast in the printing apparatus according to the embodiment.

The printing medium M transported by the first transport roller pair 9 reaches a transport drum 3 via a relay roller 10 and is transported while in close contact with the transport drum 3, which rotates in the rotation direction C. Four head units 21 are formed at positions opposing the transport drum 3. Each head unit 21 includes a head 5 configured to discharge an ultraviolet-curable ink, a pre-irradiation unit 7 provided with a suction unit 17 for suctioning mist and an ultraviolet light irradiation unit 27 configured to irradiate ultraviolet light from an LED for pre-curing as illustrated in FIG. 2 and other figures, and a gap reducing portion 6 that closes a gap G1 between the head 5 and the pre-irradiation unit 7. More specifically, a head unit 21*a* made up of a head 5*a* corresponding to cyan ink, a gap reducing portion 6*a* and a pre-irradiation unit 7*a*, a head unit 21*b* made up of a head 5*b* corresponding to magenta ink, a gap reducing portion 6*b* and a pre-irradiation unit 7*b*, a head unit 21*c* made up of a head 5*c* corresponding to yellow ink, a gap reducing portion 6*c* and a pre-irradiation unit 7*c*, and a head unit 21*d* made up of a head 5*d* corresponding to black ink, a gap reducing portion 6*d* and a pre-irradiation unit 7*d* are formed. A curing unit 8 serving as an ultraviolet light irradiation unit for curing the ultraviolet-curable ink is formed downstream in the transport direction A of the four head units 21 formed at the positions opposing the transport drum 3. Note that the head unit 21*a*, the head unit 21*b*, the head unit 21*c*, and the head unit 21*d* all have the same shape.

The four head units 21 form an image on the printing medium M that is transported while in close contact with the transport drum 3. Then, the image formed on the printing medium M by the four head units 21 is fixed to the printing medium M through the curing unit 8 curing the ink that forms the image.

A tension roller 11 is provided downstream of the curing unit 8 in the transport direction A. The printing medium M is transported from the transport drum 3 to a second transport roller pair 12 via the tension roller 11. Then, the printing medium M that has been transported by the second transport roller pair 12 is wound into a roll shape through rotating a winding unit 4 in the rotation direction C.

Here, each of the heads 5 in the printing apparatus 1 according to the present embodiment is a line head in which nozzles are formed in a line along the width direction B of the printing medium M. In other words, the printing apparatus 1 according to the present embodiment is a so-called line printer configured to continuously print while continuously transporting the printing medium M.

Next, a detailed configuration of the head unit 21, which is a main portion of the printing apparatus 1 according to the present embodiment, will be described in detail with reference to FIGS. 2 to 6. As described above, the head unit 21 in the printing apparatus 1 according to the present embodiment includes the gap reducing portion 6. The effect of including the gap reducing portion 6 will be described below with reference to FIG. 2, which illustrates the head unit 21 in the printing apparatus 1 according to the present example, and FIGS. 5 and 6, which illustrate a head unit 21 in a printing apparatus 101 according to a reference example in which the gap reducing portion 6 is not provided. Note that in FIG. 2, the configuration of the gap reducing portion 6 is illustrated in a simplified manner to facilitate explanation of the effect of providing the gap reducing portion 6. FIG. 2 illustrates a state where the gap G1 between the head 5 and the pre-irradiation unit 7 is closed by the gap reducing portion 6. However, in practice, the gap G1 between the head 5 and the pre-irradiation unit 7 in the printing apparatus 1 according to the present embodiment is only substantially closed by the gap reducing portion 6. Further, the printing apparatus 101 according to the reference example has the same configuration as the printing apparatus 1 according to the present example, except that the gap reducing portion 6 is not included.

Figure 5:
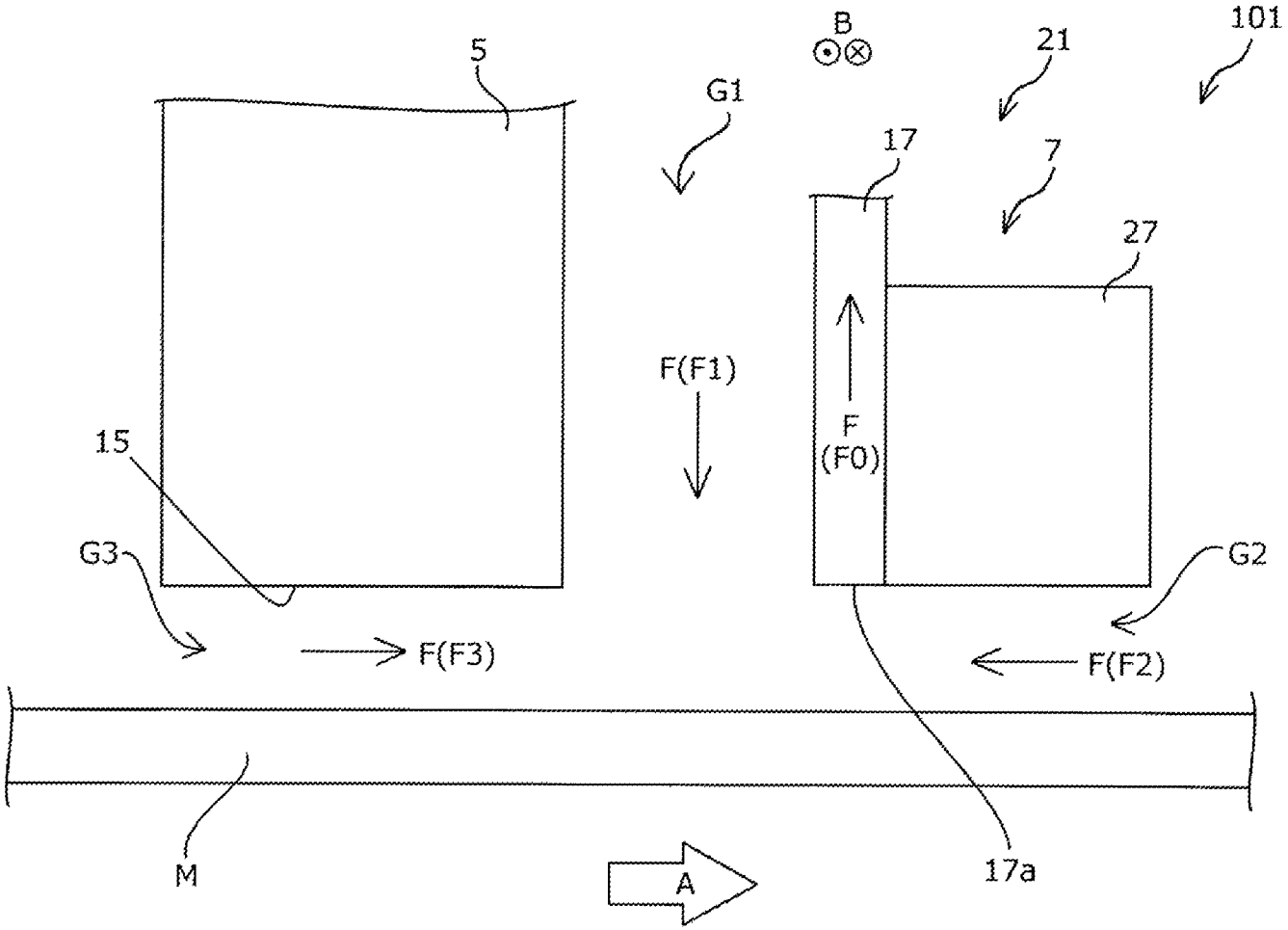
FIG. 5 is a conceptual diagram of a printing apparatus according to an embodiment of the present disclosure, and illustrates the direction of air flow when transport speed is slow in a printing apparatus according to a reference example.
Figure 6:
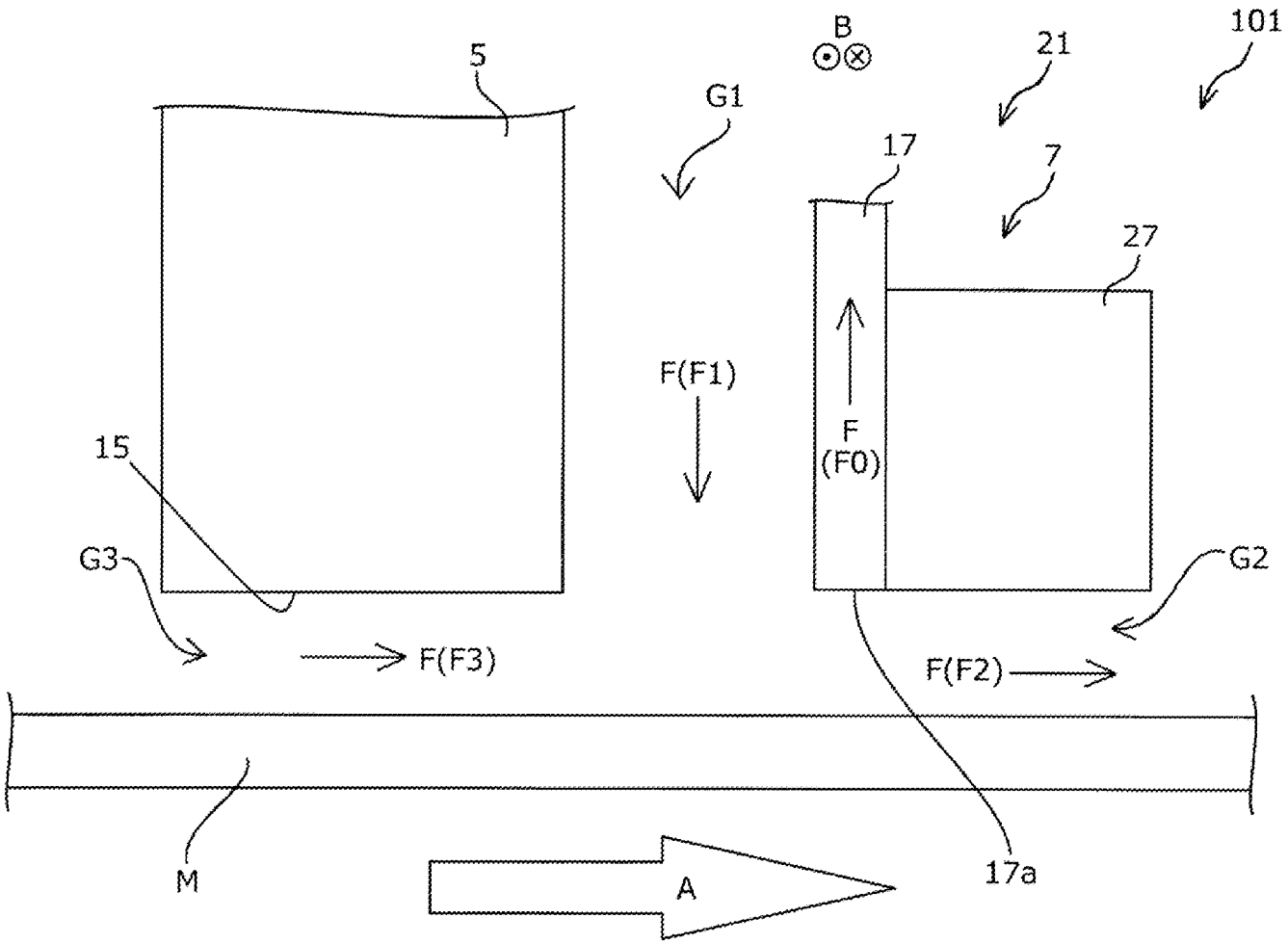
FIG. 6 is a conceptual diagram of a printing apparatus according to an embodiment of the present disclosure, and illustrates the direction of air flow when transport speed is fast in a printing apparatus according to a reference example.

As illustrated in FIGS. 2, 5, and 6, the printing apparatus 1 according to the present example and the printing apparatus 101 according to the reference example are both provided with a suction unit 17 in the pre-irradiation unit 7. The suction unit 17 is provided with a suction port 17*a*. Driving the suction unit 17 generates air flow from the suction port 17*a* toward the inside of the suction unit 17. Here, in FIGS. 2, 5, and 6, a direction F of the air flow is illustrated as a direction F0 inside the suction unit 17, a direction F1 in the gap G1 between the head 5 and the pre-irradiation unit 7, a direction F2 in a gap G2, which is a region in the pre-irradiation unit 7 where the ultraviolet light irradiation unit 27 and the printing medium M oppose other, and a direction F3 in a gap G3, which is a region in the head 5 where a nozzle-formed surface 15 formed with nozzles for discharging ink and the printing medium M oppose other. The transport direction A of the printing medium M is indicated by an arrow, and the magnitude of the transport speed of the printing medium M is indicated by the size of the arrow.

In the printing apparatus 101 according to the reference example, air flow in the direction F0 as a direction separating from the printing medium M is generated inside the suction unit 17 when the suction unit 17 is driven. This air flow originates at the suction port 17*a*. When the transport speed of the printing medium M is slow as illustrated in FIG. 5, or the printing medium M is not being transported, air flow traveling in a direction toward the suction port 17*a* is generated in the gap G1, the gap G2, and the gap G3 as indicated by the direction F1, the direction F2, and the direction F3 in FIG. 5, respectively. In other words, the direction F1 is a direction toward the printing medium M (the direction opposite to F0), the direction F2 is a direction opposite to the transport direction A, and the direction F3 is the transport direction A.

Ink mist is generated in the gap G3, which is a position opposing the nozzle-formed surface 15. However, when the direction F1, the direction F2, and the direction F3 are directions toward the suction port 17*a* as illustrated in FIG. 5, the mist generated in the gap G3 does not flow beyond the suction port 17*a* in the direction toward the ultraviolet light irradiation unit 27 (transport direction A). This is because, in the gap G2, air flow is generated in the direction F2 (opposite to the transport direction A) from the ultraviolet light irradiation unit 27 toward the suction port 17*a*. Thus, adhesion of the mist to the ultraviolet light irradiation unit 27 is suppressed.

However, if the transport speed of the printing medium M is fast as illustrated in FIG. 6, air flow in the transport direction A is generated in the vicinity of the printing medium M when the printing medium M is transported. Thus, if the transport speed of the printing medium M is fast in the printing apparatus 101 according to the reference example, air flow toward the transport direction A generated when transporting the printing medium M is stronger than air flow toward the direction opposite to the transport direction A generated when driving the suction unit 17. Further, the direction F2 is the transport direction A. When the direction F2 is the transport direction A, the mist generated in the gap G3 flows in a direction toward the ultraviolet light irradiation unit 27 beyond the suction port 17*a*. Thus, in the printing apparatus 101 according to the reference example, when the transport speed of the printing medium M is fast, the mist may adhere to the ultraviolet light irradiation unit 27.

On the other hand, as illustrated in FIG. 2, in the printing apparatus 1 according to the present embodiment, the gap G1 is narrowed by the gap reducing portion 6. Narrowing the gap G1 weakens the air flow traveling in the direction F1 toward the printing medium M in the gap G1. As a result, air flow traveling in the direction toward the suction port 17*a* in the gaps G2 and G3 becomes stronger. In other words, air flow traveling in the direction F2 (opposite to the transport direction A) toward the suction port 17*a* can be effectively generated in the gap G2. Thus, in the printing apparatus 1 according to the present embodiment, air flow traveling in the direction opposite to the transport direction A can be generated in the gap G2 even when the transport speed of the printing medium M is fast, and it is possible to effectively suppress mist from adhering to the ultraviolet light irradiation unit 27

Next, a detailed configuration of the gap reducing portion 6 in the head unit 21 of the printing apparatus 1 according to the present embodiment will be described with reference to FIGS. 3 and 4.

Figure 3:
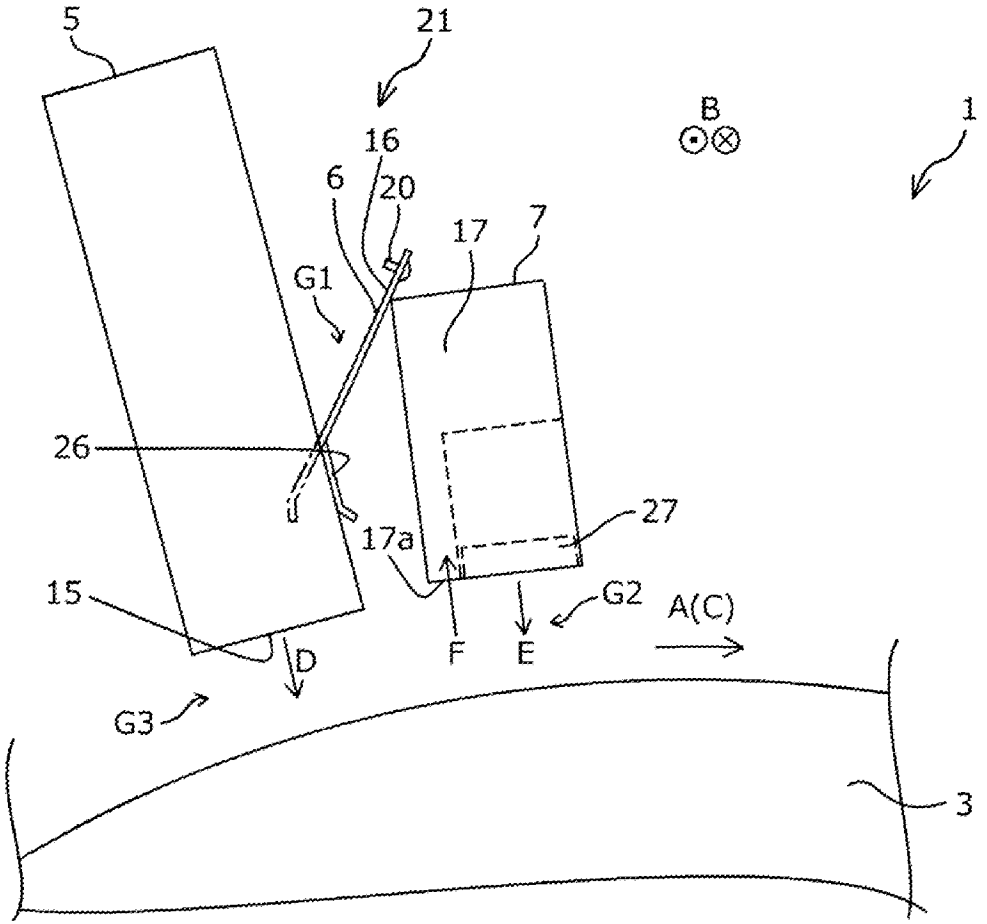
FIG. 3 is a schematic side view of a main portion of a printing apparatus according to an embodiment of the present disclosure.

As illustrated in FIG. 3, in the printing apparatus 1 according to the present embodiment, the gap reducing portion 6 is formed into a plate-like shape. The gap reducing portion 6 has a first region 16 on one end side that is brought into contact with the pre-irradiation unit 7 by being fixed to a frame (not shown) using a screw 20, and a second region 26 on a second end side that abuts against and makes contact with the head 5. Thus, the gap reducing portion 6 closes the gap G1. Note that in FIG. 3, the ink is discharged from the nozzle-formed surface 15 of the head 5 in the discharge direction D, ultraviolet light for pre-curing is irradiated in an irradiation direction E, and air flow travels in the direction F from the suction port 17*a* toward the inside of the suction unit 17 in response to driving the suction unit 17. More specifically, the discharge direction D and the irradiation direction E are directions toward the printing medium M supported by the transport drum 3, and the direction F of the air flow suctioned from the suction port 17*a* to the inside of the suction unit 17 is a direction separating from the printing medium M supported by the transport drum 3.

As described above, the printing apparatus 1 according to the present embodiment includes the first transport roller pair 9 and the second transport roller pair 12 as a transport unit for the printing medium M, the head 5 configured to discharge ultraviolet-curable ink onto the printing medium M, the ultraviolet light irradiation unit 27 disposed downstream of the head 5 in the transport direction A, the suction unit 17 provided with the suction port 17*a* for suctioning ink mist and disposed between the head 5 and the ultraviolet light irradiation unit 27 in the transport direction A, and the gap reducing portion 6 that is disposed in the gap G1 between the head 5 and the suction unit 17 in the transport direction A and at least partly closes the gap G1 through the first region 16 making contact with the suction unit 17 and the second region 26 located upstream of the first region 16 in the transport direction A making contact with the head 5.

The printing apparatus 1 is configured to generate air flow traveling in the direction opposite to the transport direction A in the gap G2, which is an opposing region where the ultraviolet light irradiation unit 27 and the printing medium M oppose each other, in response to the suction unit 17 suctioning mist while the head 5 discharges the ink onto the printing medium M to be transported.

As described above, in the printing apparatus 1 according to the present embodiment, the gap reducing portion 6 is formed between the head 5 and the ultraviolet light irradiation unit 27. Through forming the gap reducing portion 6, air flow in the gap G1 weakens and air flow toward the suction unit 17 in the gap G2 is easier to generate. It is also possible to suppress the generation of air flow in the gap G2 in the transport direction A when transporting the printing medium M. Furthermore, the printing apparatus 1 is configured such that the gap reducing portion 6 is formed and air flow traveling in the direction opposite to the transport direction A is generated in the gap G2 when suctioning mist while printing. Thus, it is possible to suppress mist generated in the head 5 from traveling toward the ultraviolet light irradiation unit 27. Therefore, it is possible to suppress the adhesion of mist to the ultraviolet light irradiation unit 27.

Note that, in the printing apparatus 1 according to the present embodiment, the ultraviolet light irradiation unit 27 and the suction unit 17 are formed integrally to form the pre-irradiation unit 7. However, the printing apparatus 1 is not limited to a configuration in which the ultraviolet light irradiation unit 27 and the suction unit 17 are integrally configured as in the present embodiment. The ultraviolet light irradiation unit 27 and the suction unit 17 may be configured separately. Further, "in contact with the suction unit 17" refers to a state where, if the ultraviolet light irradiation unit 27 and the suction unit 17 are integrally configured as in the present embodiment, being contact with an integrally configured unit as in the present embodiment.

In the printing apparatus 1 according to the present embodiment, the second region 26 of the gap reducing portion 6 is in contact with the head 5 without being fixed to the head 5. The head 5 is configured to be movable in directions approaching and separating from the printing medium M while the second region 26 is in contact with the head 5. Thus, the printing apparatus 1 according to the present embodiment has a configuration in which the gap between the head 5 and the printing medium M can be adjusted while maintaining a state where mist is suppressed from adhering to the ultraviolet light irradiation unit 27.

With the printing apparatus 1 according to the present embodiment, the printing medium M can be transported in a plurality of transport modes with different transport speeds through, for example, changing the rotational speed of the first transport roller pair 9, the second transport roller pair 12 and other components. Further, the printing apparatus 1 is configured such that air flow traveling in the direction opposite to the transport direction A is generated in the gap G2 in any transport mode. In other words, the printing apparatus 1 according to the present embodiment can transport the printing medium M in a plurality of transport modes with different transport speeds. Thus, printing can be performed based on a transport mode for printing while giving priority to printing speed and a transport mode for printing while giving priority to printing accuracy. Furthermore, regardless of the selected transport mode, it is possible to suppress mist from adhering to the ultraviolet light irradiation unit 27.

In the printing apparatus 1 according to the present embodiment, the suction unit 17 can suction mist in a plurality of suction modes with different suction strengths, and the suction mode can be set according to the selected transport mode. Because the printing apparatus 1 according to the present embodiment has a plurality of suction modes with different suction strengths, selecting the suction mode according to the selected transport mode makes it possible to effectively suppress mist from adhering to the ultraviolet light irradiation unit 27.

In the printing apparatus 1 according to the present embodiment, even if one of the transport modes is a maximum transport speed mode and that mode is selected, the gap G1 is at least partly closed to enable air flow traveling in the direction opposite to the transport direction to be generated in the gap G2. Thus, even when a maximum transport speed mode is selected, the printing apparatus 1 according to the present embodiment can suppress mist from adhering to the ultraviolet light irradiation unit 27. Note that, in the present embodiment, the printing apparatus 1 is configured such that the gap G1 is entirely closed without any gaps, as illustrated in FIGS. 3 and 4. However, the printing apparatus 1 may be configured such that the gap G1 is partly closed, provided that air flow traveling in the direction opposite to the transport direction is generated in the gap G2.

In the printing apparatus 1 according to the present embodiment, the gap reducing portion 6 is formed of a flexible resin. Because the gap reducing portion 6 is formed of a flexible member, the gap G1 can be closed with a simple configuration. In particular, it is easy to form a configuration that does not hinder movement of the head 5 if the head 5 is movable in directions approaching and separating from the printing medium M as in the present embodiment. In addition to resins, a thin metal plate, a sponge, or the like may also be used as the flexible member.

In FIG. 3, the gap reducing portion 6 is in contact with the head 5 in the second region 26 and is therefore deflected in the second region 26. However, if the gap reducing portion 6 is not in contact with the head 5 because, for example, the head 5 has been removed such as indicated by the dot-dash line in FIG. 3, the gap reducing portion 6 has a substantially linear flat plate shape in side view. The shape of the gap reducing portion 6 is preferably a flat plate shape so as to easily form a flexible configuration, but the shape of the gap reducing portion 6 is not limited thereto.

Figure 4:
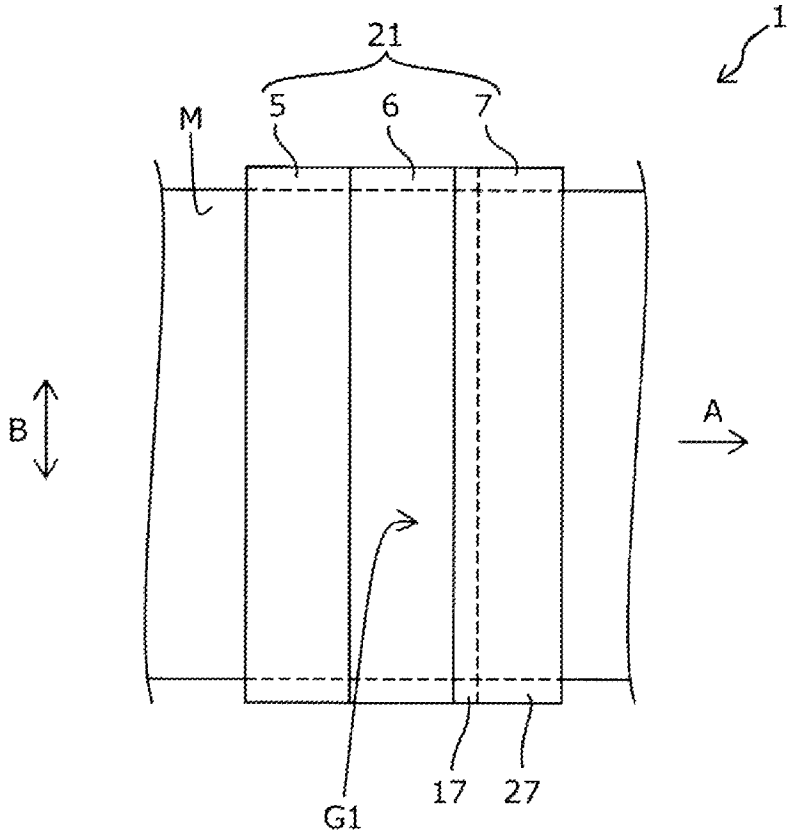
FIG. 4 is a schematic plan view illustrating a main portion of a printing apparatus according to an embodiment of the present disclosure.

As illustrated in FIG. 4, in the printing apparatus 1 according to the present embodiment, the length of the gap reducing portion 6 in the width direction B, which is an intersecting direction that intersects with the transport direction, is the same as the length of the head 5 in the width direction B. Thus, the length of the gap reducing portion 6 in the width direction B is preferably greater than or equal to the length of the head 5 in the width direction B. By setting the length of the gap reducing portion 6 in the width direction B greater than or equal to the length of the head 5 in the width direction B, it is possible to effectively generate air flow toward the suction unit 17 in the gap G2 and effectively suppress mist from adhering to the ultraviolet light irradiation unit 27.

Note that the disclosure is not limited to the aforementioned example, and many variations are possible within the scope of the disclosure as described in the appended claims. It goes without saying that such variations also fall within the scope of the disclosure.

What is claimed is:

1. A printing apparatus comprising:

a transport unit for a printing medium;

a head configured to discharge ultraviolet-curable ink onto the printing medium;

an ultraviolet light irradiation unit disposed downstream of the head in a transport direction of the printing medium;

a suction unit provided with a suction port for suction mist of the ink, the suction port being provided between the head and the ultraviolet light irradiation unit in the transport direction; and a gap reducing portion disposed in a gap between the head and the suction unit in the transport direction and configured to at least partially close the gap by a first region being in contact with the suction unit and a second region, located upstream of the first region in the transport direction, being in contact with the head, the gap reducing portion being formed of a flexible member, wherein in response to the suction unit suctioning the mist while the head discharges the ink onto the printing medium to be transported, air flow traveling in a direction opposite to the transport direction is generated in an opposing region where the ultraviolet light irradiation unit and the printing medium oppose each other.

2. The printing apparatus according to claim 1, wherein:

the second region of the gap reducing portion makes contact with the head without being fixed to the head; and the head is movable in directions approaching and separating from the printing medium in a state where the second region is in contact with the head.

3. The printing apparatus according to claim 1, wherein:

the transport unit is configured to transport the printing medium in a plurality of transport modes of different transport speeds; and air flow traveling in the direction opposite to the transport direction is generated in the opposing region in any of the transport modes.

4. The printing apparatus according to claim 3, wherein the suction unit is configured to suction in a plurality of suction modes of different suction strengths, and the suction mode is configurable according to the transport mode.

5. The printing apparatus according to claim 3, wherein, even in a maximum transport speed mode among the transport modes, the gap reducing portion at least partly closes the gap such that air flow traveling in the direction opposite to the transport direction is generated in the opposing region.

6. The printing apparatus according to claim 1, wherein the gap reducing portion has a length, in an intersecting direction that intersects with the transport direction, greater than or equal to a length of the head in the intersecting direction.

7. A printing apparatus comprising:

a transport unit for a printing medium;

a head configured to discharge ultraviolet-curable ink onto the printing medium;

an ultraviolet light irradiation unit disposed downstream of the head in a transport direction of the printing medium;

a suction unit provided with a suction port for suction mist of the ink, the suction port being provided between the head and the ultraviolet light irradiation unit in the transport direction; and a gap reducing portion disposed in a gap between the head and the suction unit in the transport direction and configured to at least partially close the gap by a first region being in contact with the suction unit and a second region, located upstream of the first region in the transport direction, being in contact with the head, wherein in response to the suction unit suctioning the mist while the head discharges the ink onto the printing medium to be transported, air flow traveling in a direction opposite to the transport direction is generated in an opposing region where the ultraviolet light irradiation unit and the printing medium oppose each other, and wherein the gap reducing portion has a length, in an intersecting direction that intersects with the transport direction, greater than or equal to a length of the head in the intersecting direction.

8. The printing apparatus according to claim 7, wherein:

the second region of the gap reducing portion makes contact with the head without being fixed to the head; and the head is movable in directions approaching and separating from the printing medium in a state where the second region is in contact with the head.

9. The printing apparatus according to claim 7, wherein:

the transport unit is configured to transport the printing medium in a plurality of transport modes of different transport speeds; and air flow traveling in the direction opposite to the transport direction is generated in the opposing region in any of the transport modes.

10. The printing apparatus according to claim 9, wherein the suction unit is configured to suction in a plurality of suction modes of different suction strengths, and the suction mode is configurable according to the transport mode.

11. The printing apparatus according to claim 9, wherein, even in a maximum transport speed mode among the transport modes, the gap reducing portion at least partly closes the gap such that air flow traveling in the direction opposite to the transport direction is generated in the opposing region.

* * * * *